US010085506B2

(12) United States Patent
Dinh

(10) Patent No.: US 10,085,506 B2
(45) Date of Patent: Oct. 2, 2018

(54) METHOD FOR APPLYING EYELASH EXTENSIONS VIA STRIP WEAVING

(71) Applicant: Daniel Phu Dinh, Beverly Hills, CA (US)

(72) Inventor: Daniel Phu Dinh, Beverly Hills, CA (US)

( * ) Notice: Subject to any disclaimer, the term of this patent is extended or adjusted under 35 U.S.C. 154(b) by 0 days.

(21) Appl. No.: 15/250,809

(22) Filed: Aug. 29, 2016

(65) Prior Publication Data

US 2017/0079357 A1 Mar. 23, 2017

Related U.S. Application Data

(60) Provisional application No. 62/211,486, filed on Aug. 28, 2015.

(51) Int. Cl.
*A41G 5/02* (2006.01)

(52) U.S. Cl.
CPC ..... *A41G 5/02* (2013.01)

(58) Field of Classification Search
CPC ..... A41G 5/02; A41G 5/006; A41G 5/0053; A41G 5/004; A41G 5/00
USPC ..... 132/201
See application file for complete search history.

(56) References Cited

U.S. PATENT DOCUMENTS 8,196,591 B2 * 6/2012 Lee ..... A41G 5/02 132/201
2015/0114421 A1 * 4/2015 Pham ..... A41G 5/02 132/201

FOREIGN PATENT DOCUMENTS

WO WO 2014/139943 * 9/2014

* cited by examiner

*Primary Examiner* — Cris L Rodriguez
*Assistant Examiner* — Brianne Kalach
(74) *Attorney, Agent, or Firm* — Tope-McKay & Associates

(57) ABSTRACT

Described is a method for applying an eyelash extension strip. The method comprises several acts, such as applying a first eyelash extension strip to a user such that a portion of the first eyelash extension strip is on top of at least one of the user's natural lashes. The first eyelash extension strip is then weaved underneath at least one of the user's natural lashes and then woven back on top of the user's natural lashes. In another aspect, the first eyelash extension strip is adhered to at least one of the user's eyelid and natural lashes. Additionally, a second eyelash extension strip can be adhered on top of the first eyelash extension strip.

4 Claims, 4 Drawing Sheets

(Prior Art Method)

METHOD FOR APPLYING EYELASH EXTENSIONS VIA STRIP WEAVING

CROSS-REFERENCE TO RELATED APPLICATIONS

This is a non-provisional application of U.S. Provisional Application No. 62/211,486, filed on Aug. 28, 2015.

BACKGROUND OF THE INVENTION (1) Field of Invention

The present invention relates to eyelash extensions and, more particularly, to a method for applying, eyelash extensions via strip weaving.

(2) Description of Related Art

Beauty products have long been known in the art. Users, women in particular, have sought a variety of beauty products to enhance their aesthetic appearance. For example, blush is often used to add color to a woman's cheeks. As another example, lipstick is traditionally used to add a variety of colors and features to a user's lips. To enhance the appearance of a user's eyelashes, some eyelash technicians apply individual eyelash extensions to a user's natural lashes. While individual eyelash extensions provide a very real appearance, the procedure is costly. Thus, in an attempt to reduce application time and costs, some technicians apply eyelash strips to the top of a user's natural eyelashes. A problem with such a technique is that the eyelash strips may fall off and do not typically add an appearance of fullness to the existing lashes.

Therefore, there is a continuing need for a method for applying eyelash strips that increase retention and add fullness to existing lashes.

SUMMARY OF INVENTION

The present invention relates to eyelash extensions and, more particularly, to a method for applying eyelash extensions via strip weaving. The method comprises several acts, such as applying a first eyelash extension strip to a user such that a portion of the first eyelash extension strip is on top of at least one of the user's natural lashes. The first eyelash extension strip is then weaved underneath at least one of the user's natural lashes and then woven back on top of the user's natural lashes. In another aspect, the first eyelash extension strip is adhered to at least one of the user's eyelid and natural lashes. Additionally, a second eyelash extension strip can be adhered on top of the first eyelash extension strip.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to eyelash extensions and, more particularly, to a method for applying eyelash extensions via strip weaving. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, the labels left, right, front, back, top, bottom, forward, reverse, clockwise and counter clockwise have been used for convenience purposes only and are not intended to imply any particular fixed direction. Instead, they are used to reflect relative locations and/or directions between various portions of all object.

(1) Description

Figure 1:
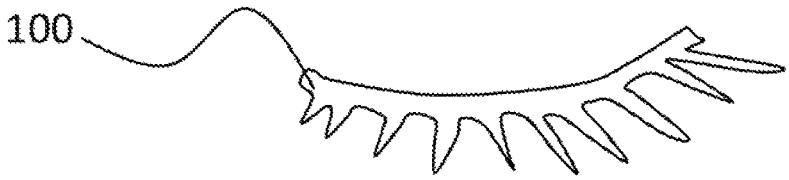
FIG. 1 is an illustration of a typical eyelash strip that includes an elongated strip having a plurality of eyelashes extending therefrom.
Figure 2:
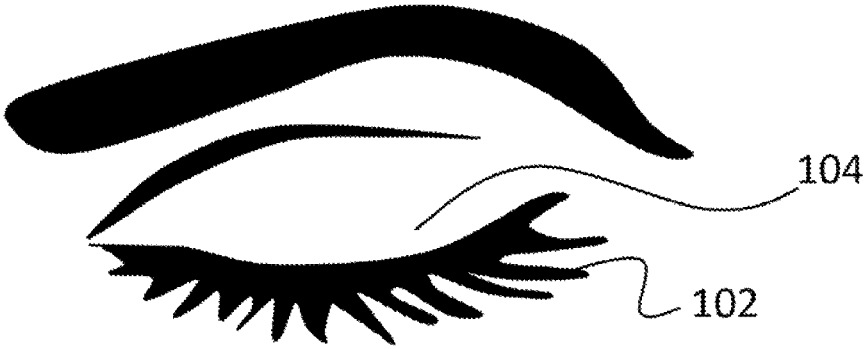
FIG. 2 is an illustration of a closed eye.
Figure 3:
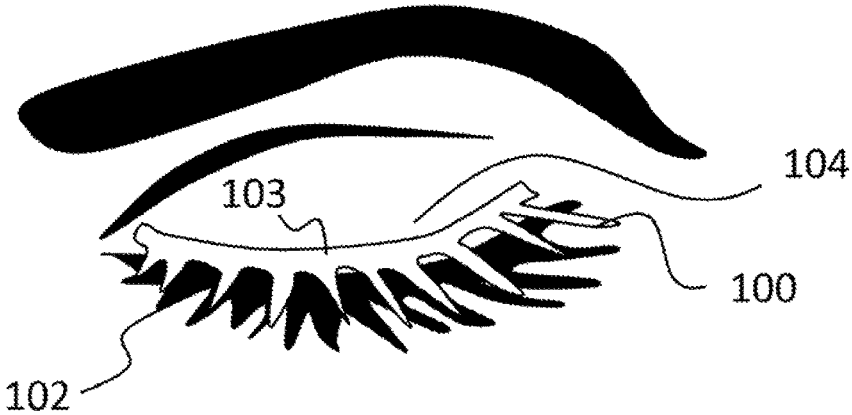
FIG. 3 is an illustration depicting a method of the prior art for applying an eyelash strip to a user's closed eye.

The present invention relates to eyelash extensions and, more particularly, to a method for applying eyelash extension snips via strip weaving. For example, an eyelash strip typically includes an elongated strip base (such as a tape or glue strip) with a plurality of individual or branched lashes extending therefrom. An example of such a typical eyelash strip 100 is illustrated in FIG. 1. The traditional process for applying such an eyelash strip 100 is to glue, tape, or otherwise adhere the strip base 103 to the top of the users existing eyelashes 102 (e.g., top eyelashes) or against the user's upper eyelid 104, as shown between FIGS. 2 and 3.

Figure 4:
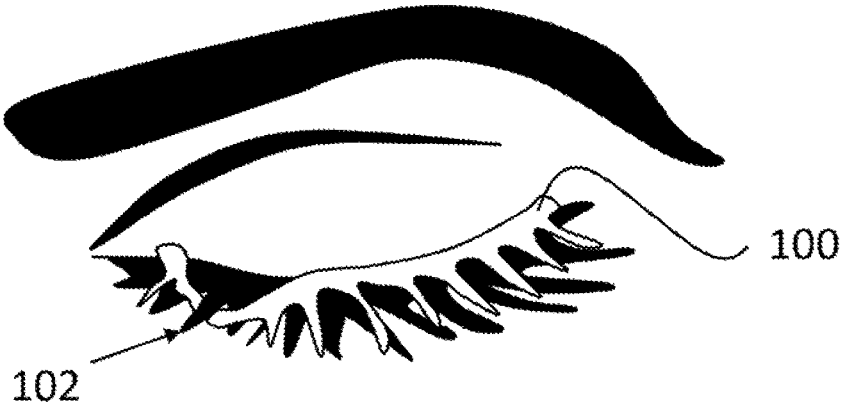
FIG. 4 is an illustration depicting a method for applying eyelash extensions according to various embodiments of the present invention.
Figure 5:
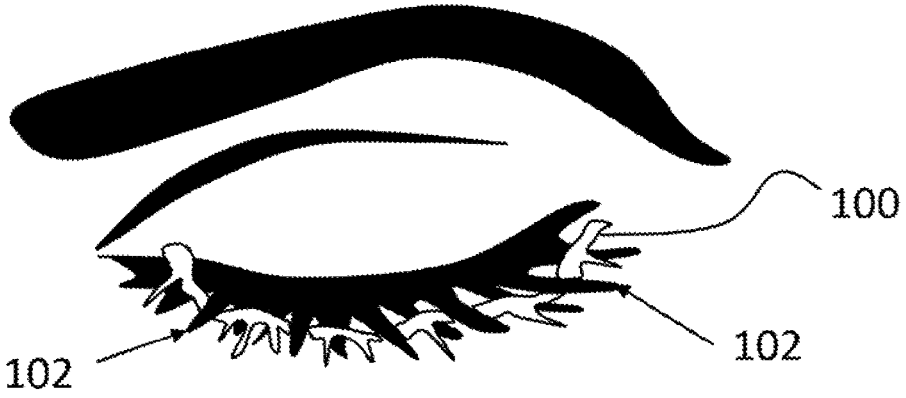
FIG. 5 is an illustration depicting a method for applying eyelash extensions according to various embodiments of the present invention.
Figure 6:
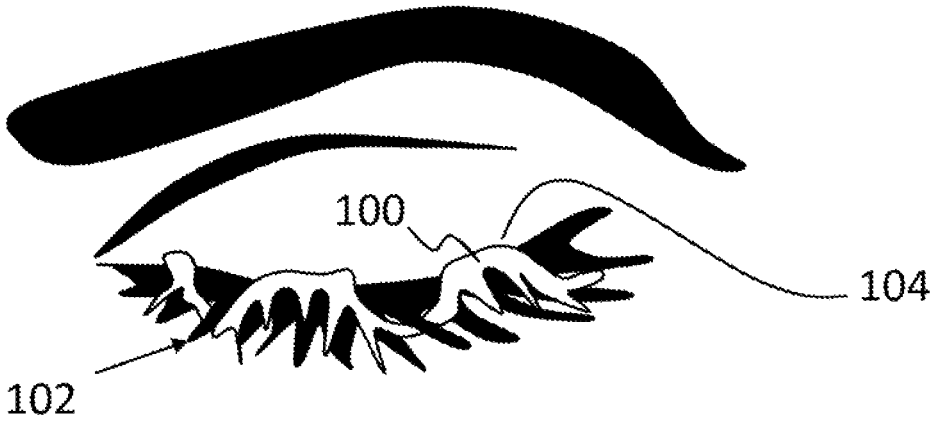
FIG. 6 is an illustration depicting a method for applying eyelash extensions according to various embodiments of the present invention.

The present invention improves upon the method of the prior art by providing a method in which the eyelash strip 100 is woven under and/or over one or more of the user's natural eyelashes. For example and as shown in FIGS. 4, 5, and 6, the method includes acts of applying a portion of the eyelash strip 100 over (i.e., on top of) the user's natural lashes, weaving a portion of the strip 100 underneath at least one of the user's natural lashes 102, with the eyelash strip 100 then weaving back on top of user's natural lashes. This process can cease with a single underneath weave (as shown in FIG. 4) or can continue under and over for any desired number or weaves or until the end of the eyelash strip (as shown in FIG. 6). It should also be noted that the eyelash strip can be affixed directly to the top of the user's natural lashes 102 (as shown in FIGS. 4 and 5) or against the user's eyelid (above the natural lashes 102 (or below if affixed to the user's bottom lashes)) or any other desired location or combination thereof. The eyelash strip 100 is affixed to the natural lashes 102 or user's eyelid 104 using an adhesive, tape, or any other method.

Figure 7:
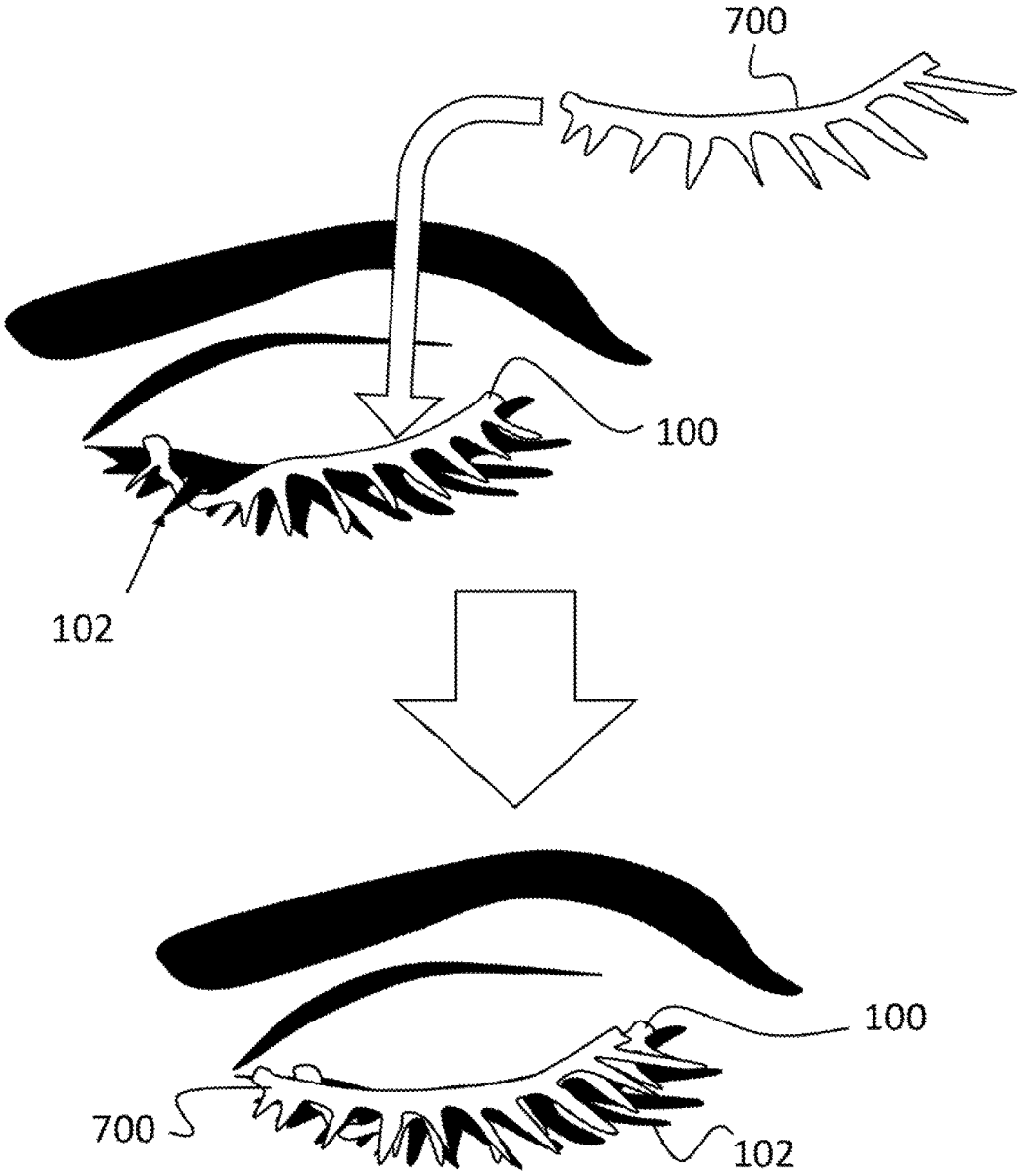
FIG. 7 is an illustration depicting a method for applying eyelash extensions according to various embodiments of the present invention.

In another aspect and as shown in FIG. 7, after a first eyelash strip 100 is woven onto the natural lashes 102 (using any of the processes or method described above and herein, including any of the processes as shown in FIG. 4, 5 or 6), one or more additional eyelash strips 700 is adhered on top of or underneath the natural lashes 102 (and first eyelash strip 100), OR, on top of and underneath the natural lashes 102 (and first eyelash strip 100), or any combination thereof.

It should also be noted that the eyelash strip is any type of eyelash strip, non-limiting examples of which include an eyelash strip with threads at the root, eyelash strip with knots at the root, or strips without threads at the root, or any other kind of eyelash strip. In other words, it should be explicitly understood that the method described herein can be employed with any type of eyelash strip that includes a plurality of eyelashes extending therefrom. It should also be noted that the process as described above and illustrate herein can be applied to either the user's top or bottom natural lashes, or any combination thereof.

What is claimed is:

1. A method for applying an eyelash extension strip, comprising acts of:

providing a first eyelash extension strip having a plurality of eyelashes extending therefrom; and taking the first eyelash extension strip with the plurality of eyelashes and weaving the first eyelash extension strip above and below the user's natural lashes.

2. The method as set forth in claim 1, further comprising an act of adhering the first eyelash extension strip to at least one of the user's eyelid and natural lashes.

3. The method as set forth in claim 2, further comprising an act of adhering a second eyelash extension strip on top of the first eyelash extension strip.

4. The method as set forth in claim 1, wherein in weaving the first eyelash extension strip, the first eyelash extension strip is applied to a user such that a portion of the first eyelash extension strip is on top of at least one of the user's natural lashes, with the first eyelash extension strip then weaving underneath at least one of the user's natural lashes and then weaving back on top of the user's natural lashes.

* * * * *